United States Patent [19]

Koren et al.

[11] Patent Number: 4,860,562

[45] Date of Patent: Aug. 29, 1989

[54] ACTUATING DEVICE AND KEY

[76] Inventors: Izchak Koren, 49 Florence Avenue, Bedfordview, Transvaal Province; Robert J. Gates, 19 Third Avenue,, Northmead, Benoni, Transvaal Province; Craig J. Smith, No 6 Beacon Royal, Cnr. Grafton and Louis Botha, Yeoville, Transvaal Province, all of South Africa

[21] Appl. No.: 934,740

[22] Filed: Nov. 25, 1986

[30] Foreign Application Priority Data

Nov. 28, 1985 [ZA] South Africa ..... 85/9125

[51] Int. Cl.[4] ..... E05B 27/06

[52] U.S. Cl. ..... 70/352; 70/377; 70/392

[58] Field of Search ..... 70/352, 350, 351, 363, 70/377, 392

[56] References Cited

U.S. PATENT DOCUMENTS

| | | | |
|---|---|---|---|
| 211,832 | 2/1879 | Brooks et al. | 70/352 |
| 1,105,161 | 7/1914 | Schaub | 70/352 |
| 4,164,857 | 8/1979 | Genakis | 70/352 |
| 4,287,737 | 9/1981 | Ahm | 70/352 |
| 4,587,815 | 5/1986 | Gil | 70/352 |

FOREIGN PATENT DOCUMENTS 2197406 3/1974 France .

*Primary Examiner*—Robert L. Wolfe

*Attorney, Agent, or Firm*—Benjamin J. Barish

[57] ABSTRACT

An actuating device has a cartridge within a fixed casing. A card-like key has a key formation which, during insertion of the key into the cartridge, displaces a finger formation connected to an interference formation, which is then aligned with a gate of a gate member fixed to the casing. The gate allows passage to the interference formation allowing the cartridge to be displaced in unison with the key. An actuating formation on the cartridge is provided to actuate a lock or similar device.

13 Claims, 5 Drawing Sheets

ACTUATING DEVICE AND KEY

This invention relates to the combination of a lock actuating device and a key therefor.

According to the present invention, there is provided, in combination, a lock actuating device and a key therefor, of the kind in which the key resembles a card, the lock actuating device comprising: a casing formed with a slot for receiving the key; a cartridge disposed within the casing and arranged for displacement in an actuating direction and defining an internal zone within the casing; a slide member mounted on the cartridge for displacement in a direction transverse to the actuating direction between an interference position and a free position, and having a finger formation extending into the internal zone, and an interference formation operatively connected to the finger formation; and a gate member fixed to the casing and having a check formation and a gate, the gate member being arranged such that the check formation checks movement of the interference formation in the actuating direction when the slide member is in its interference position and such that the gate allows movement of the interference formation in the actuating direction when the slide member is in its free position; the key having a key formation complemental to the finger formation and being arranged, when the key is inserted into the slot of the casing, to cause displacement of the slide member to its free position to allow displacement of the slide member and cartridge in unison in the actuating direction, the cartridge being adapted for operative connection to an actuatable device such as to cause actuation of the device when it moves in the actuating direction in use.

The invention is now described by way of example with reference to the accompanying diagrammatic drawings. In the drawings FIG. 1 shows, in three dimensional view, an exploded view of the combination of a lock actuating device and a card key in accordance with the invention;

Figure 1:
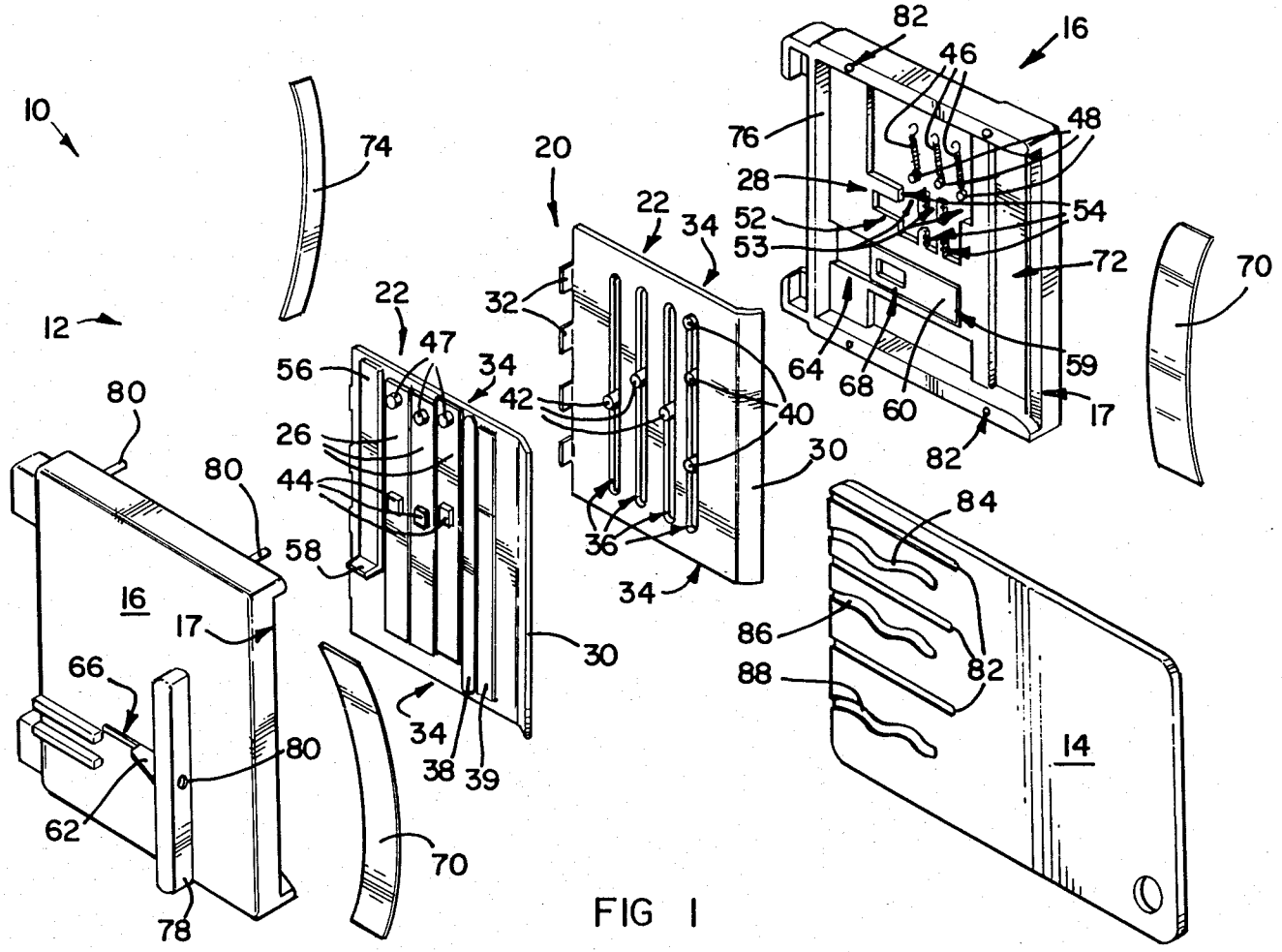
Figure 3:
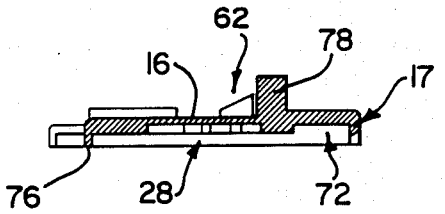
FIG. 3 shows a sectional view taken at III—III in FIG. 2.
Figure 2:
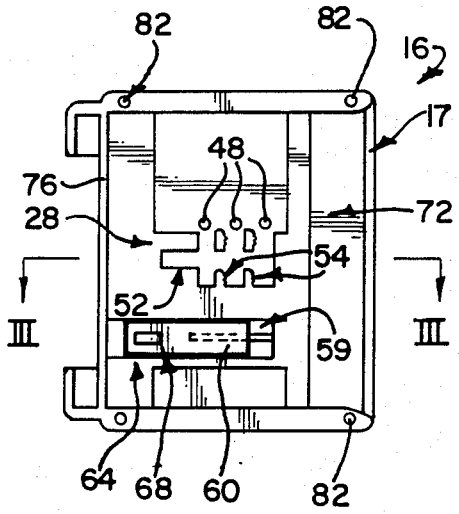
FIG. 2 shows, an inside view of a casing half of the actuating device of FIG. 1.
Figure 4:
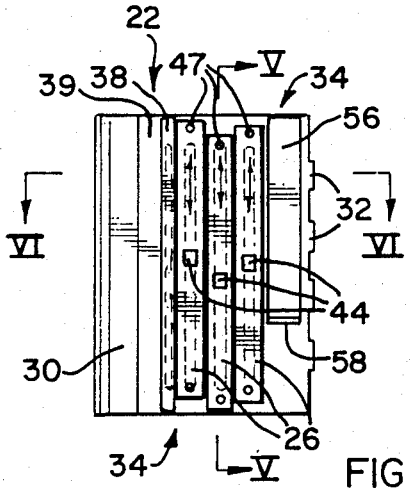
FIG. 4 shows an outside view of a cartridge half of the actuating device of FIG. 1.
Figure 5:
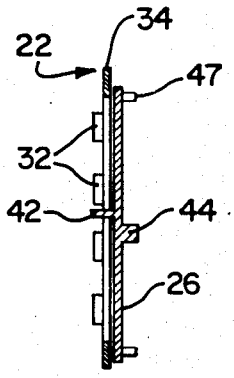
FIG. 5 shows a section taken at V—V of FIG. 4.
Figure 6:
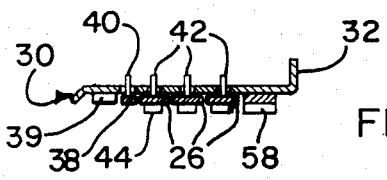
FIG. 6 shows a section taken at VI—VI of FIG. 4.
Figure 7:
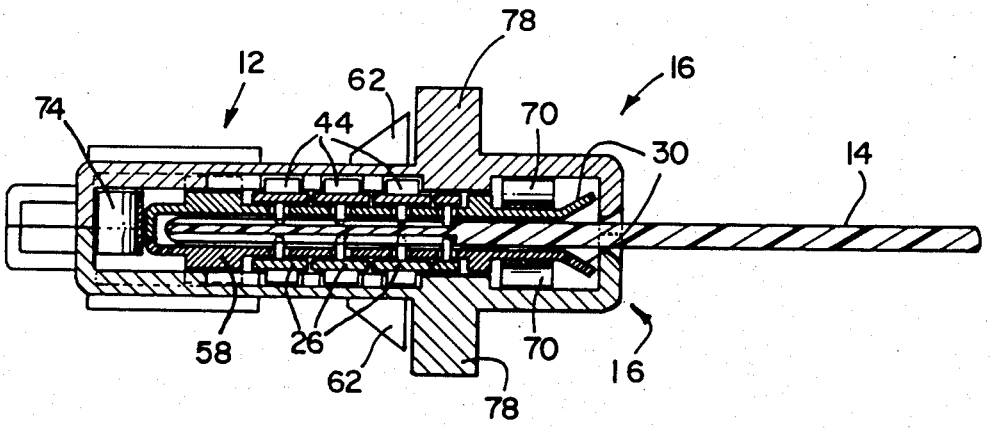
FIG. 7 shows, in sectional top plan view, the combination of FIG. 1 in assembled condition.

With reference to FIGS. 1 to 8 of the drawings, a combination in accordance with the invention is generally indicated by reference numeral 10. The combination 10 comprises a lock actuating device 12 and a card key 14 therefor.

The lock actuating device 12 comprises an outer casing in the form of two casing halves 16 in the form of mouldings. When assembled the casing houses a cartridge generally indicated at 20 and comprising two cartridge halves respectively indicated at 22.

Generally, opposed halves of the lock actuating device 12 are similar, i.e. they are, generally, mirror images. In the drawings some features of one of the halves and other features of the other of the halves are shown. Concealed features of one half are generally similar to, but not necessarily identical to, exposed features of the other half. Thus, for convenience, the features exposed are described as belonging to either half. Similar features are numbered alike.

The cartridge halves 22 are in the form of bent, plate metal, stampings have outwardly bent fore edges 30, weakly interlocking tongues 32 along their rears pivotally to interconnect the cartridge halves in assembled condition, and upper and lower side edges 34. The fore edges 30 define a mouth leading into an internal zone between the halves 22. Fore edges of the casing halves 16 are recessed as indicated at 17 to co-operate to define the mouth.

Each cartridge half 22 comprises four parallel slots 36 adjacent each other and parallel to the fore edges 30. The slots 36 extend from positions near one side edge 34 to corresponding positions near the opposed side edge 34. A guide strip 39 is provided fixed to each cartridge half from the outside adjacent and in front of the slot 36 closest to the fore edge 30. A profiling strip 38 is located adjacent and immediately to the rear of the guide strip 39, over the slot 36 closest to the fore edge 30. A plurality of profiling formations 40 (three formations 40 are shown in this embodiment) extend from each profiling strip 38 through the slot 36 into the internal zone intermediate the cartridge halves 22. The arrangement of the profiling formations 40 can be varied for different actuating devices and contributes to the uniqueness of a particular actuating device.

At the outside of each cartridge half 22, there are slidably mounted three slide members 26 in line with the slots 36 adjacent the slot 36 having the strip 38. Each slide member 26 comprises an outwardly extending interference formation 44 which formations are at predetermined positions when the slide members 26 are in their rest positions. Fixed to the insides of the slide members 26 and projecting via the respective slots 36 into the internal zone between the cartridge halves 22, there are provided fingers 42 in predetermined positions which can be varied for different actuating devices and which contribute to the uniqueness of a particular actuating device.

Coil springs 46 are provided fixed at their one ends to stubs 48 integral with the casing halves 16 and having hooks 50 which are, in assembled condition, hooked over stubs 47 of the slide members 26 to operate in tension resiliently to bias the slide members 26 to rest positions toward the lower side edges 34 of the cartridge halves 22.

Integral with each of the casing halves 16 there is provided a gate member 28 in the form of a recess in its casing half 16. Each gate member 28 has an actuating passage 52 parallel to a side edge thereof. It further has three slide passages 53 perpendicularly across the passage 52, corresponding to the three slide members 26. The slide passages 53 are bounded by checking formations 54 in accordance with the invention. When assembled, the interference formations 44 are engaged in the slide passages 53, out of alignment with the actuating passage 52 and are thus checked by the checking formations 54 against movement in any direction transverse to the passages 53. This position is herein referred to as the interference position. Operation of the actuating device, which is described hereinafter, effects displacement of the fingers 42 and thus also of the slide members 26 and the interference formations 44 along the passages 53 such that the interference formations are aligned with the actuating passage 52. In that position, which is referred to as the free position, the slide members 26 and cartridge 20 can move in unison in an actuating direction corresponding to the orientation of the actuating passage 52.

At the outside of each cartridge half 22, there is fixed a bar 56 parallel to, and to the rear of, the slide members 26. At its bottom, it has an outwardly turned lug 58.

An actuating member 59 is slidably located in a recess 64 at the inside of each casing half 16 and orientated in the actuating direction. Each actuating member 59 comprises a flat base 60, and an erect actuating formation 62 extending through its casing half 16 via a slot 66 also orientated in the actuating direction. A socket 68 is provided in the base 60 in a position such that it is engaged by the lug 58 of the bar 56 when the actuating device is assembled. Displacement of the cartridge 20 along the actuating passage 52 during operation slides the actuating members 59 and thus also the actuating formation 62 correspondingly. The actuating formations 62 in use operate an operable device such as a mechanical or electrical lock or the like.

A pair of leaf springs 70 is provided respectively in seats 72 toward the fore edges of the casing halves 16 to bias the fore edges 30 of the cartridge halves 22 toward each other to close the mouth to the internal zone between the cartridge halves 22.

A further leaf spring 74 is provided in abutment with rears 76 of the casing halves 16 and with the interlocking tongues 32 of the cartridge halves 22 to bias the cartridge 20 toward the mouth of the casing halves 16.

A mounting flange 78 having a threaded bore 80 is provided at the outside of each casing half 16 to fix the casing to a substrate in use.

The card key 14 has, from a leading edge, and along each side, a plurality of profile grooves 82 corresponding to the plurality of profiling formations 40 at a corresponding side of the cartridge half. The profile grooves are parallel to one another and to sides of the card key 14 and are arranged in correspondence to the predetermined arrangement of the profiling formations 40. Thus, only a card key 14 having complemental profile grooves can be inserted into the mouth of the actuating device 12 beyond the profiling formations 40.

Furthermore, the card key 14, at each side, has actuating grooves 84, 86, 88 respectively associated with the fingers 42 of each cartridge half 22. The positions of the actuating grooves at the leading end of the card key 14 corresponds to the rest positions of the fingers 42. It is to be appreciated that the operative portion of the actuating groove 84 is shorter than the operative portion of the actuating groove 86 which is shorter than the operative portion of the actuating groove 88. Thus, the actuating groove 84 will be associated with the finger 42 closest to the mouth of the actuating device, the actuating groove 86 with the intermediate finger and the actuating groove 88 with the finger toward the rear of the cartridge 20. The total lengths of the actuating grooves 84, 86, 88 are conveniently equal as is shown in the drawing. The actuating grooves 84, 86, 88 slope irregularly to operative end positions predetermined for the particular actuating device such that when the respective fingers are in the respective end positions, the slide members 26 are displaced such that the interference formations 44 are in their free positions and are aligned with the actuating passages 52 of their gate members 28. Thus, in that position, continued insertion of the card key 14 displaces the cartridge 20 as a whole against the bias of the leaf spring 74 to displace the actuating formations 62 to actuate the device.

It is to be appreciated that the cartridge 20 cannot be forced to move in the actuating direction by inserting e.g. a sturdy flat piece of material roughly the size of the card into the internal zone and forcing it rearwardly. The weak rear wall formed by the interlocking tongues 32 of the cartridge 20 will merely give way, and the actuating device will remain in its locked condition.

Figure 8:
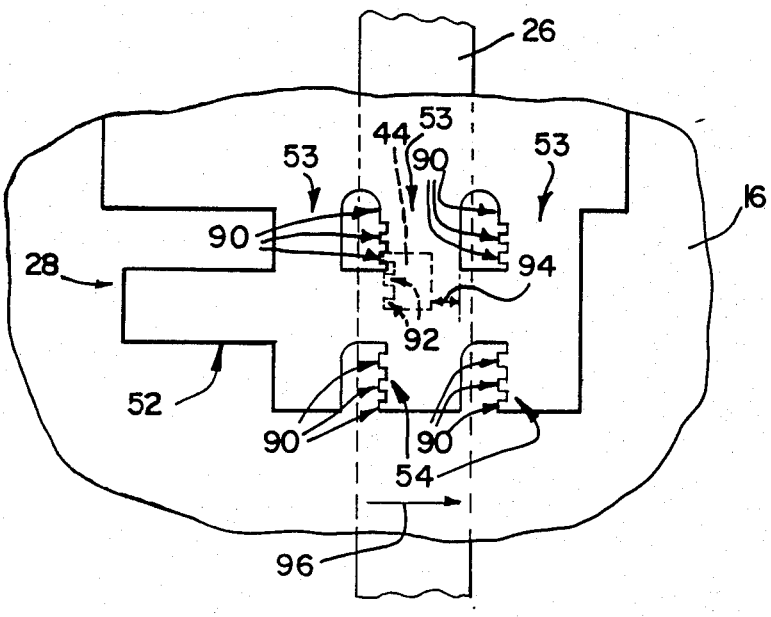
FIG. 8 shows, in front view to a larger scale, a gate member of the actuating device of FIG. 1.
Figure 10:
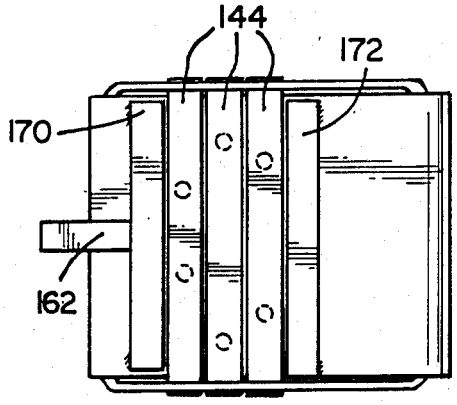
FIG. 10 shows, in side view, the lock actuating device of FIG. 9.
Figure 12:
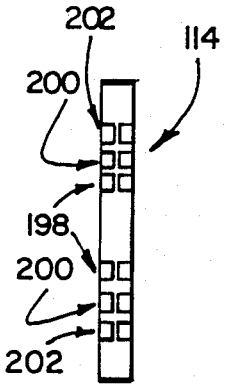
FIGS. 11 and 12 show, respectively in side view and in end view, the key of FIG. 9.
Figure 11:
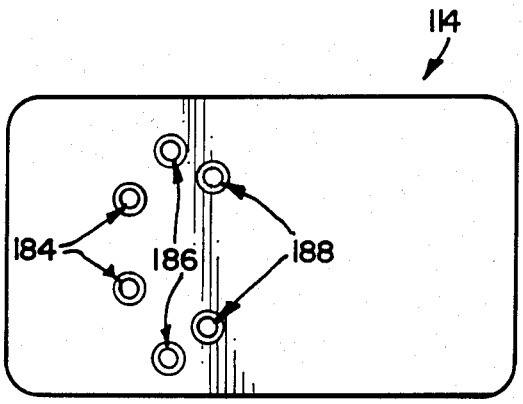
Figure 9:
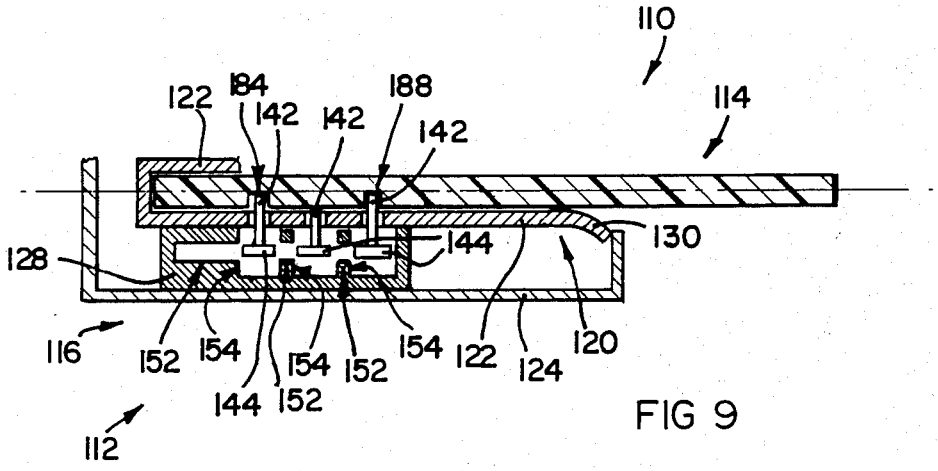
FIG. 9 shows, fragmentarily, in sectional plan view, another embodiment of a lock actuating device and key in accordance with the invention.

With reference to FIG. 8, the gate member 28 has the three passages 53, bounded by the checking formations 54, and also the passage 52 in the actuating direction.

A plurality of recesses 90 are defined, tooth-fashion, spaced along one sides of two of the passages 53 in the checking formations 54 and specifically along the sides facing from the mouth. The corresponding interference formations 44 (only one is shown in dotted outlines) have at least one, and, in the embodiment shown, a plurality of complemental teeth 92 at corresponding sides. The interference formation 44 is received within the passage 53 with lost motion indicated at 94 in the lateral direction corresponding to the effective depth of the recesses 90/effective height of the teeth 92.

The passage 53 not having the recesses 92 is narrower than the passages 53 which do have the recesses 92. The purpose of this is to ensure that, in normal use, the respective interference formation 44 will be checked against the side of the smooth passage 53 before interengagement of the teeth 92 and recesses 90 can take place. Normal operation thus takes place without meshing.

However, if the actuating device is sought to be picked by means of individual manipulation of the interference formations 44 via the mouth of the actuating device, the interference formations will be urged toward the recessed walls (allowed by the lost motion 94) and meshing will take place to lock the interference formations 44 in the passages 53, thus preventing such unauthorized operation of the actuating device.

Provision of teeth and recesses adds a further parameter to the degree of integrity of the lock actuating device.

With reference to FIGS. 9 to 12 of the drawings, another embodiment of an actuating device 112 and key in the form of a card 114 is generally indicated by reference numeral 110. The combination 110 is similar to the combination 10 of FIG. 1 and like parts are numbered similarly. The combination 110 is not described in detail, but merely the differences from the combination 10 are highlighted.

The device 112 has two sets of bars 144 which are movable transversely i.e. perpendicularly, to the plane of the halves 122 of the cartridge 120. The bars are fixed to pins 142, two pins being provided for each bar. The pins are slidable through apertures (corresponding to the slots 36) in the halves 122. The bars and their pins are resiliently biassed inwardly by means of bias means which are not shown. The bias means may conveniently be springs.

Each half of the device 112 has a pair of gate members 128, respectively at the top and bottom of the casing halves 116. Opposed ends of each bar 144 provide interference formations in accordance with the invention. Such ends of bars extend into the gate members 128, each of which has passages 154 within which the bar ends are freely movable in a direction perpendicular to the plane of the card 114 when inserted. It is to be appreciated that, when the bars are at rest, and are inwardly biassed, the bar ends will interfere with check formations provided by sides of said passages 154. Similarly, when the bars are biassed fully outwardly, the bar ends will interfere with said check formations. When the pins 142 are held in predetermined intermediate positions, the bar ends are aligned with gates leading to longitudinally extending passages 152 allowing the bar ends and thus also the whole cartridge 120 to move longitudinally with respect to the casing 116.

The bars 144 are held captive against sideward movement relative to the cartridge halves 122 by means of bars 170 and 172 fixed to the cartridge sides. A longitudinally extending central actuating formation 162 is provided fast with each cartridge side 122. Thus, when the cartridge 120 is displaced longitudinally with respect to the casing 116, the actuating formations 162 are displaced in unison. It is allowed passage through a wall of the casing 116 via slots which are not shown.

The card 114 has, at positions corresponding to the positions of the pins 142, sockets in symmetric pairs indicated at 184, 186 and 188. It is not essential that the pins, and thus also the sockets, are arranged symmetrically but it facilitates displacement of the bars 144. The depth of the sockets are predetermined to hold the pins 142 in their predetermined intermediate positions. If desired, the depths of the sockets may vary to add another parameter to the degree of uniqueness of the combination 110. The depths may, e.g., respectively be about 0,5; 1,0; 1,5 mm when the card is about 2 mm thick. The sockets have tapered, outwardly diverging, sides to facilitate withdrawal of the card from underneath the pins.

To enable the card 114 to slide underneath the pins 142 when they are biassed inwardly, bevelled ramps generally indicated at 198, 200 and 202 (illustrated only in FIG. 12 and not shown in FIG. 11) are provided in the leading edge of the card. In this embodiment, it is shown that the positions of the pins 142 of the two halves correspond and that the ramps correspond as well. That is not necessarily the case as the two halves can be dissimilar to add yet another parameter to the degree of uniqueness of the combination 110. The ramps may then be of a height substantially equal to the thickness of the card 114 as opposed to half the thickness of the card 114.

Figure 13:
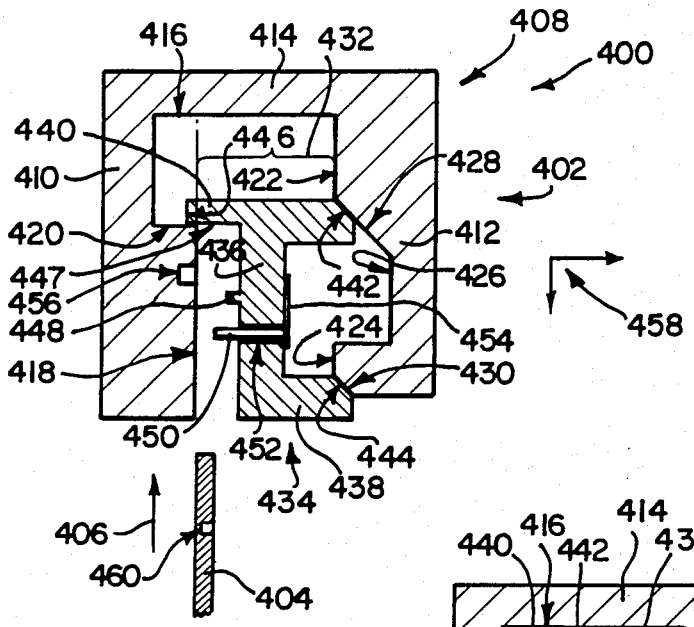
FIG. 13 shows, in sectional plan view, yet a further embodiment of a lock actuating device and a key in accordance with the invention.
Figure 14:
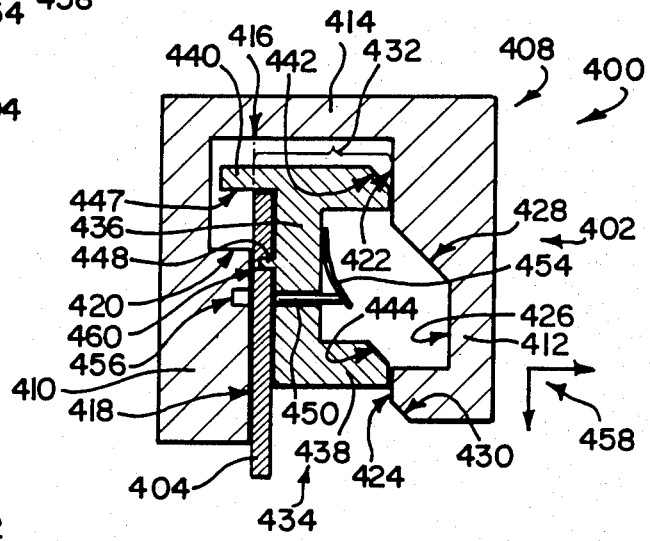
FIG. 14 shows, in sectional plan view, the device and key of FIG. 13 in use.
Figure 15:
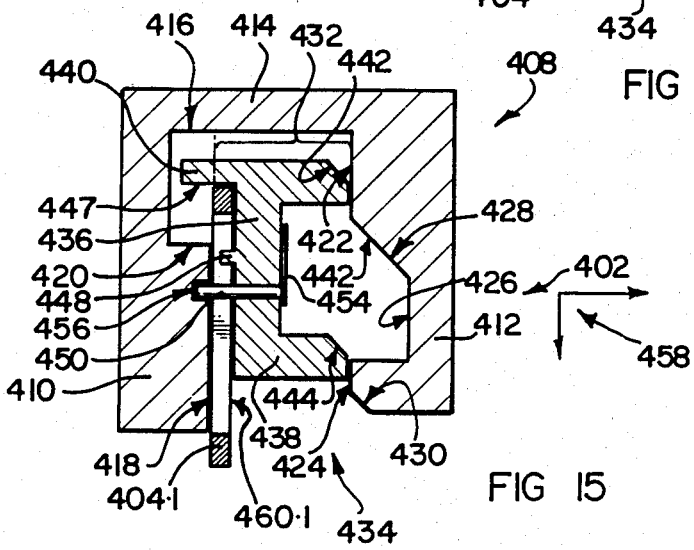
FIG. 15 shows, in sectional plan view, the device of FIG. 13 being sought to be operated by means of an unauthorized skeleton key.

With reference to FIGS. 13, 14 and 15 a further embodiment of an actuating device and key in combination in accordance with another aspect of the invention is generally indicated by reference numeral 400. The combination comprises an actuating device 402 and a key 404. The key 404 is intended to be inserted into the device 402 in use in a first direction indicated at 406.

The actuating device 402 comprises a casing 408 which is substantially U-shaped (shown inverted in the drawings) having limbs 410 and 412 and a base 414 interconnecting one ends of the limbs. Adjacent the base 414 and between the limbs 410 and 412, there is defined an internal zone 416.

The limb 410 is inwardly thickened toward its free end defining an inner slide surface 418. The thickened portion is bounded by an internal shoulder 420.

The second limb 412 has, toward its fixed end and toward its free end inner slide surfaces 422 and 424 which are aligned. In between those slide surfaces, it is recessed as indicated at 426. An oblique shoulder 428 interconnects the inner slide surface 422 and the recess 426. A corresponding, parallel oblique shoulder 430 leads outwardly from the outer slide surface 424.

A gate opening, having a length indicated at 432, is defined between the slide surfaces 418 and 422, 424.

The device 402 further comprises an interference member 434 which is of substantially J-section. (In the drawings, the J is reflected back to front). The interference member 434 has a centre limb 436, a lower limb 438 extending to one side of the centre limb toward the second limb 412 of the casing 408, and an upper cross limb 440 extending beyond the centre limb 436 to either side. Ends of the limbs 438 and 440 adjacent the second limb 412, have oblique shoulders 442 and 444 parallel to and complemental to the oblique shoulders 428 and 430. At its opposed side, the upper limb 440 has an orthogonal end 446. The upper limb 440 defines a shoulder 447 extending between the end 446 and the centre limb 436. A protrusion in the form of a fixed pin 448 extends perpendicularly from the centre limb 436 toward the first limb 410. The centre limb 436 defines a perpendicular through passage 452 accommodating a floating pin 450 standing proud of the centre limb 436 parallel to the fixed pin 448. The floating pin 450 is biassed toward the first limb 410 of the casing 408 by means of a leaf spring 454.

The limb 410 has in its slide surface 418 a socket 456 complemental to the floating pin 450.

The interference member 434 is biassed toward the second limb 412 and outwardly, oppositely to the direction of insertion 406, as indicated at 458 by means of biassing means which are not shown. The faces 430 and 428 interfere and prevent the displacement of the interference member 434 purely in the direction 406.

The interference member 434 mounts an actuating formation which is not shown and which is arranged to actuate an actuable device such as an electrical or mechanical lock when the interference member 434 is displaced into the internal zone 416 in an actuating direction corresponding to the first direction, i.e. the direction of insertion 406.

The key 404 has a socket 460 complemental to the fixed pin 448.

Operation of the combination 400 is now described in more detail.

In FIG. 13, the condition of the device 402 is shown at rest.

When the key 404 is inserted in the direction 406 between the slide surface 418 and the centre limb 436, it displaces the floating pin 450 against its bias and passes between the outer end of the fixed pin 448 and the slide surface 418. When an end of the key abuts the shoulder 447, it urges the interference member 434 against its bias into the internal zone 416 in the direction 406. Simultaneously, the interference member 434, owing to sliding of the oblique shoulders 442 and 444 over the corresponding oblique shoulders 428 and 430, is displaced sidewardly toward the slide surface 418. The fixed pin 448 enters the socket 460. The floating pin 450 is checked by the side of the key 404. Receipt of the fixed pin 448 within the socket 460, allows the interference member 434 to be displaced sidewardly to a position spaced by the thickness of the card key 404 from the slide surface 418 to allow the ends of the limbs 438 and 440 to slide along the slide surfaces 424, 422 and 418 via the gate opening 432 into the internal zone 416 to actuate the actuable device.

When the interference member 434 is urged in the direction 406 without using a key 404, or by using of a card in the form of a peripheral frame as indicated at 404.1 in FIG. 15, the floating pin 450 is not checked and engages the socket 456 in the limb 410 to prevent further movement of the interference member 434 into the internal zone 416, thus preventing actuating of the actuable device.

When a card not having an appropriate socket 460, e.g. a solid card or other piece of material, is used to operate the device 402, the fixed pin 448 cannot enter into such card or piece of material and the interference member 434 cannot be displaced sidewardly far enough to run off the oblique shoulders 428 and 430. Thus, the interference member 434 cannot be displaced deeply enough into the internal zone 416 to effect actuating of the actuable device.

It is to be appreciated that more than one fixed pin 448 and more than one floating pin 450 can be used to add to the integrity of the actuating device 402. It is further to be appreciated that the combination of the positions of the fixed pin(s) 448 and of the floating pin(s) 450, are unique to a particular actuating device 402. Thus, only a proper key having complementally arranged socket(s) and land portion(s) can be used to operate the device.

We claim:

1. In combination, a lock actuating device and a key therefor, of the kind in which the key resembles a card, the lock actuating device comprising:

a casing formed with a slot for receiving the key:

a cartridge disposed within said casing and arranged for displacement in an actuating direction and defining an internal zone within said casing;

a slide member mounted on the cartridge for displacement in a direction transverse to said actuating direction between an interference position and a free position, and having a finger formation extending into the internal zone, and an interference formation operatively connected to the finger formation;

and a gate member fixed to said casing and having a check formation and a gate, the gate member being arranged such that the check formation checks movement of the interference formation in said actuating direction when the slide member is in its interference position and such that the gate allows movement of the interference formation in the actuating direction when the slide member is in its free position;

the key having a key formation complemental to the finger formation and being arranged, when the key is inserted into the slot of the casing, to cause displacement of the slide member to its free position to allow displacement of the slide member and cartridge in unison in said actuating direction, the cartridge being adapted for operative connection to an actuatable device such as to cause actuation of the device when it moves in said actuating direction in use.

2. The combination as claimed in claim 1, wherein said finger formation is carried at one side of the slide member, and said interference formation is carried on the opposite side of the slide member.

3. The combination as claimed in claim 2, wherein said gate member comprises an actuating passage extending in the actuating direction, and said check formation of the gate member comprises a further passage on each of the opposite sides of the actuating passage and extending perpendicular thereto.

4. The combination as claimed in claim 1 in which the slide member, finger formation and interference formation are integral in the form of a moulding.

5. The combination as claimed in claim 1 in which the finger formation extends transversely into the internal zone and transversely to the plane of the key when inserted into the internal zone.

6. The combination as claimed in claim 5 in which the key formation is in the form of a socket of a predetermined depth.

7. The combination as claimed in claim 5 in which the finger formation is displaceable transversely to the direction of motion of the key and parallel to the plane of the key when it is inserted, the key formation being in the form of a groove which is non-parallel to the direction of motion of the key when it is inserted.

8. The combination as claimed in claim 1 in which the slide member is resiliently biassed to its interference position.

9. The combination as claimed in claim 1, in which the lock actuating device comprises a plurality of slide members having respectively a corresponding plurality of finger and interference formations, the gate member having a corresponding plurality of gates, and in which the key has a corresponding plurality of key formations.

10. In combination, an actuating device and a key resembling a card, the key having a key formation predetermined for the particular combination;

the actuating device comprising:

a casing formed with a slot defining a mouth leading into an internal zone in a first direction and adapted to accept insertion of the key during an initial stage of travel;

a finger formation disposed within said internal zone, the finger formation being displaceable from a rest position transversely to said first direction and being arranged when in its rest position for engagement by, and displacement by, the key formation during the initial stage of travel of the key into the internal zone in the first direction in use;

an interference formation operatively connected to the finger formation to be in an interference position corresponding to the rest position of the finger formation and to be displaced in a direction transverse to an actuating direction to a free position in response to displacement of the finger formation in use;

a gate member fixed to said casing, said gate member including:

a checking formation arranged to check movement of the interference formation in the actuating direction when it is in its interference position, and a gate arranged to allow movement of the interference formation in the actuating direction when it is in its free position in response to travel of the key subsequent to said initial stage; and an actuating member arranged to be displaced in response to displacement of the actuating formation in the actuating direction, the actuating member being suitable to engage a device such as an electrical or mechanical lock, to actuate it when displaced in use.

11. A combination as claimed in claim 10 in which the first direction, the actuating direction and the direction of displacement of the actuating member are parallel.

12. A combination as claimed in claim 11 in which the finger formation, interference formation and the actuating member are arranged to move in unison with the key during said subsequent stage of travel.

13. In combination, an actuating device and a key resembling a card, the key having a key formation in the form of a socket at a position predetermined for the particular combination;

the actuating device comprising:

a casing formed with a slot defining a mouth leading into an internal zone in a first direction and adapted to accept insertion of the key during an initial stage of travel in said first direction;

check formations fixed to said casing and defining a gate;

an interference member displaceable within said casing and having a protrusion complemental to, and positioned in accordance with the position of, the socket, and being biassed transversely to said first direction to a position in which it interferes with the check formations fixed to the casing;

guide means adapted, in response to movement of the key during said initial stage of travel, to displace the interference member against its bias, and to align the protrusion with, and to guide it into, the socket to cause the interference member to be positioned only closely spaced from the key in a position in which it is aligned with the gate; and an actuating formation arranged, in response to movement of the key during a subsequent stage of travel in use, to actuate a device such as an electrical or mechanical lock or the like.

* * * * *